US008291682B2

(12) United States Patent
Dodson et al.

(10) Patent No.: US 8,291,682 B2
(45) Date of Patent: Oct. 23, 2012

(54) SADDLE PAD COVER

(76) Inventors: Aimee A. Dodson, Klamath Falls, OR (US); Gladys M. Woldt, Sutherlin, OR (US)

( * ) Notice: Subject to any disclaimer, the term of this patent is extended or adjusted under 35 U.S.C. 154(b) by 248 days.

(21) Appl. No.: 12/491,086

(22) Filed: Jun. 24, 2009

(65) Prior Publication Data

US 2009/0260335 A1 Oct. 22, 2009

Related U.S. Application Data

(63) Continuation of application No. 29/286,850, filed on May 21, 2007, now abandoned.

(51) Int. Cl.
*B68C 1/12* (2006.01)

(52) U.S. Cl. ..... 54/66; 54/44.1

(58) Field of Classification Search ..... 54/65, 66, 54/44.1

See application file for complete search history.

(56) References Cited

U.S. PATENT DOCUMENTS

| | | | | |
|---|---|---|---|---|
| 545,573 | A | 9/1895 | Bringham | |
| 1,127,748 | A | 2/1915 | Faurot | |
| 1,349,258 | A | 8/1920 | Blocksom | |
| 2,218,951 | A | 10/1940 | Flaharty | |
| 2,446,396 | A | 8/1948 | Theodore | |
| 2,580,904 | A | 1/1952 | Faulkner, Jr. | |
| 2,659,421 | A | 11/1953 | Wass et al. | |
| 2,778,413 | A | 1/1957 | Benjamin | |
| 3,305,878 | A | 2/1967 | Hellbaum | |
| D273,540 | S | 4/1984 | Wagner et al. | |
| D274,347 | S | 6/1984 | Budde | |
| 4,522,447 | A | 6/1985 | Snyder et al. | |
| 4,634,176 | A | 1/1987 | Scott | |
| 4,765,126 | A * | 8/1988 | Bates | 54/44.7 |
| D298,715 | S | 11/1988 | Swim | |
| 5,067,771 | A | 11/1991 | Ellis | |
| 5,111,544 | A | 5/1992 | Graebe | |
| D326,959 | S | 6/1992 | VanDuser et al. | |
| D336,203 | S | 6/1993 | Lin | |
| D341,052 | S | 11/1993 | Fogel | |
| D342,857 | S | 1/1994 | Mocur | |
| D357,609 | S | 4/1995 | Webb et al. | |
| 5,424,519 | A | 6/1995 | Salee | |
| 5,568,660 | A | 10/1996 | Raburn et al. | |
| D383,320 | S | 9/1997 | Gilbertson | |
| D385,709 | S | 11/1997 | Gryp | |
| D394,366 | S | 5/1998 | Graebe et al. | |
| D400,044 | S | 10/1998 | Rosenberg | |
| D402,497 | S | 12/1998 | Holley | |
| D407,256 | S | 3/1999 | Backlund | |
| D414,368 | S | 9/1999 | Wingard | |
| D416,718 | S | 11/1999 | Chatman | |

(Continued)

OTHER PUBLICATIONS

Equine Supplies at Jeffers Equine product list (7 pages), www.jeffersequine.com, © 1999-2009.

*Primary Examiner* — Rob Swiatek
*Assistant Examiner* — Lisa Tsang
(74) *Attorney, Agent, or Firm* — Winthrop & Weinstine, P.A.

(57) ABSTRACT

A saddle pad cover is disclosed and may include a first layer and a second layer, the first layer being coupled to the second layer, a closure device adapted for insertion of a saddle pad, and a patch positioned on the surface of the first layer, where the saddle pad cover may sleevably receive a saddle pad to form an assembly. A method of maintaining a saddle pad cover is also disclosed.

9 Claims, 5 Drawing Sheets

U.S. PATENT DOCUMENTS

| | | | | |
|---|---|---|---|---|
| D418,339 | S | 1/2000 | Smith et al. | |
| D421,359 | S | 3/2000 | Liao | |
| 6,050,067 | A * | 4/2000 | Knight et al. | 54/44.6 |
| D424,337 | S | 5/2000 | Smith et al. | |
| D425,341 | S | 5/2000 | Smith et al. | |
| D427,820 | S | 7/2000 | Chen | |
| D431,136 | S | 9/2000 | Palardis | |
| D439,775 | S | 4/2001 | Sauey et al. | |
| D440,106 | S | 4/2001 | Weisz | |
| D440,453 | S | 4/2001 | Roberts et al. | |
| D441,588 | S | 5/2001 | Roberts et al. | |
| D446,983 | S | 8/2001 | Roberts et al. | |
| D448,229 | S | 9/2001 | Su et al. | |
| 6,352,306 | B1 | 3/2002 | Dreiling | |
| 6,370,850 | B1 * | 4/2002 | Zilka | 54/66 |
| 6,474,052 | B2 * | 11/2002 | Kempsell et al. | 54/44.6 |
| D467,085 | S | 12/2002 | Kamiki | |
| 6,502,902 | B1 | 1/2003 | Romero | |
| D478,456 | S | 8/2003 | Yoon | |
| 6,601,250 | B1 | 8/2003 | Taylor | |
| D497,507 | S | 10/2004 | Keilhauer | |
| D508,182 | S | 8/2005 | Colonello | |
| D512,258 | S | 12/2005 | Colonello | |
| D516,346 | S | 3/2006 | Cobb | |
| 7,069,710 | B2 * | 7/2006 | Kwan et al. | 54/66 |
| 7,104,605 | B2 | 9/2006 | Jones | |
| 7,191,480 | B2 | 3/2007 | Romano et al. | |
| D552,387 | S | 10/2007 | Wu et al. | |
| D557,045 | S | 12/2007 | Faber et al. | |
| D557,965 | S | 12/2007 | Rybinski | |
| 7,334,278 | B2 | 2/2008 | Yamasaki | |
| 2002/0152730 | A1 * | 10/2002 | Landi et al. | 54/65 |
| 2003/0205920 | A1 | 11/2003 | Sprouse et al. | |
| 2006/0250004 | A1 | 11/2006 | Jones | |

* cited by examiner

SADDLE PAD COVER

CROSS-REFERENCE TO RELATED APPLICATIONS

The present application is a continuation-in-part application of and claims priority to U.S. Design patent application 29/286,850, filed on May 21, 2007, entitled, Lazy Daizy Western Saddle Pad Cover, the content of which is hereby incorporated by reference herein in its entirety.

FIELD OF THE INVENTION

The present application relates to sleeve-type covers. More particularly, the present application relates to textile-based sleeve-type covers. Even more particularly, the present application relates to textile-based sleeve-type covers for saddle pads.

BACKGROUND

At least two types of horse back riding include bare back riding or, alternatively, riding with a saddle. In the case of using a saddle, it is also common to include a saddle pad between the horse and the saddle. That is, when preparing a horse for riding, a saddle pad may be placed on the horse's back prior to placing a saddle.

Saddle pads are often made from a padding type material for cushioning the horse against pressure from the saddle and for spreading the load from the saddle out more evenly across the horse's back. As such, the saddle pad may be relatively stiff and may resist folding.

Over the course of using a saddle pad, the pad may become soiled from being outside, exposed to the elements, and also due to perspiration of the horse upon which it is placed. However, due to the size and relative stiffness of the pads, washing them can be difficult because they may not fit in a regularly sized washing machine and/or may not conform to the contours of the washing machine. This can cause the pads to be damaged if washed in a machine and thus, may require that they be washed in a commercial machine or by hand. Moreover, once washed, the padding type material of the pad may have a tendency to retain water and drying may take a long time. There is a need in the art for a machine washable saddle pad that dries quickly.

BRIEF SUMMARY

In one embodiment, a saddle pad cover may include a first layer and a second layer, the first layer being coupled to the second layer, a closure device adapted for insertion of a saddle pad, and a patch positioned on the surface of the first layer. In another embodiment, the first layer may be a saddle-side layer and the second layer may be a horse-side layer. In another embodiment, the patch may be a wear resistive patch. In another embodiment, the first layer may have a lateral edge and the wear resistive patch may be positioned along the lateral edge. In another embodiment, the wear resistive patch may be positioned to fall below a fender of a saddle. In another embodiment, the saddle pad cover may include a water resistive system. In another embodiment, the water resistive system may be an inner system. In another embodiment, the water resistive system may be a polyurethane laminate fabric. In another embodiment, the first layer and the second layer each may respective perimeter edges and the closure device may be positioned along the perimeter edges. In another embodiment, the closure device may be positioned on the first layer. In another embodiment, a portion of the saddle pad cover may be convertible. In another embodiment, the first layer and the second layer may be coupled along a full length of their perimeter edges with the closure device. In another embodiment, the patch may be removably coupled to the first layer. In another embodiment, the first layer may have a first perimeter edge defining a first boundary and the second layer may have second perimeter edge defining a second boundary, the first boundary may be smaller than the second boundary, and the first layer may be coupled to the second layer within the second boundary.

In another embodiment, a saddle pad assembly may include a saddle pad and a saddle pad cover adapted to sleevably receive the saddle pad. In another embodiment, the saddle pad may include a first layer and a second layer with respective perimeter edges, the layers coupled to one another along a first portion of their respective perimeter edges, a closure device adapted for insertion of a saddle pad, the closure device being positioned along a second portion of the perimeter edges, and a patch positioned on the surface of the first layer. In another embodiment, the patch may be a wear resisting patch.

In another embodiment, a method of maintaining a saddle pad cover may include removing a saddle pad assembly from a horse, the saddle pad assembly including a saddle pad cover with a closure device sleeved over a saddle pad, opening the closure device, removing the saddle pad from the saddle pad cover, and placing the saddle pad cover in a washing machine. In another embodiment, opening the closure device may include unzipping a zipper. In another embodiment, the method may also include arranging the saddle pad cover for drying.

Further aspects of the invention will be brought out in the following portions of the specification, wherein the detailed description is for the purpose of fully disclosing preferred embodiments of the invention without placing limitations thereon.

DETAILED DESCRIPTION

The present disclosure relates to sleeve-type covers for saddle pads. The cover may be sleeved over a saddle pad to create a saddle pad assembly and the assembly may be used in lieu of a conventional saddle pad. That is, when saddling up a horse, the assembly may be placed upon the horse's back in lieu of a saddle pad and the saddle may then be placed upon the assembly. After use, the assembly may be disassembled by removing the cover from the saddle pad. The cover may then be washed in a washing machine and dried without the problems associated with washing the whole saddle pad.

The cover may be made from multiple types and combinations of fabric or other materials and may be configured to sleevably receive a saddle pad. The cover may be openable and closeable to facilitate repeatedly inserting and/or removing a saddle pad from the cover. The cover may be made from flexible materials, such that, once a saddle pad is removed, the cover can be washed readily in a washing machine. The cover may be adapted to resist slippage between the saddle and the horse. The cover may further be adapted to resist penetration of moisture so as to maintain the saddle pad in a dry and/or unsoiled state and the cover may also be adapted to resist wear in locations exposed to repetitive rubbing and abrasion.

Figure 1:
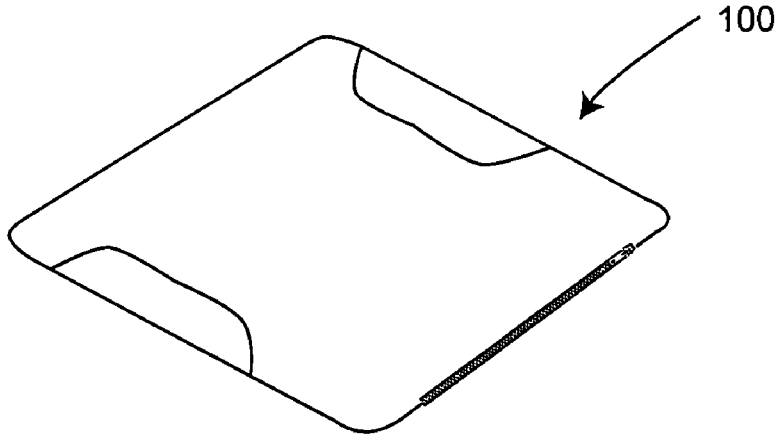
FIG. 1 is a perspective view of a saddle pad cover, according to certain embodiments.
Figure 2:
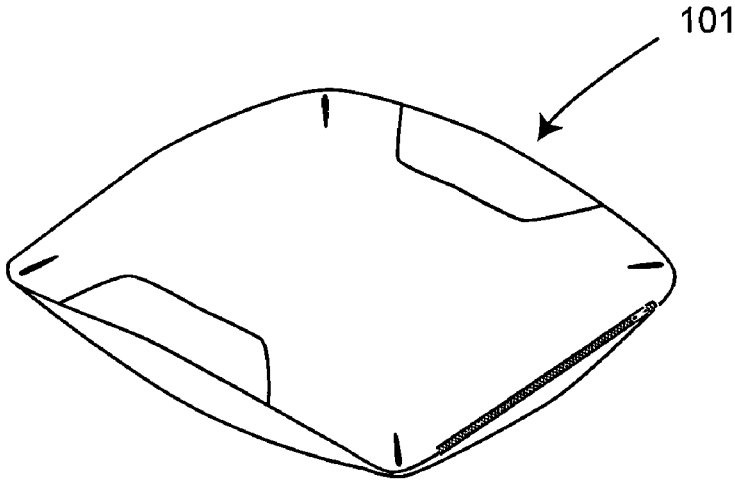
FIG. 2 is a perspective view of a saddle pad cover sleeved over a saddle pad, according to certain embodiments.

Referring now to FIG. 1, a stand alone saddle pad cover 100 is shown. In FIG. 2, a saddle pad assembly 101 is shown where the saddle pad cover 100 is sleeved over a saddle pad 103 (hidden to view). As shown, the saddle pad cover 100 may be dimensioned for a tight fit over the saddle pad 103.

Figure 3:
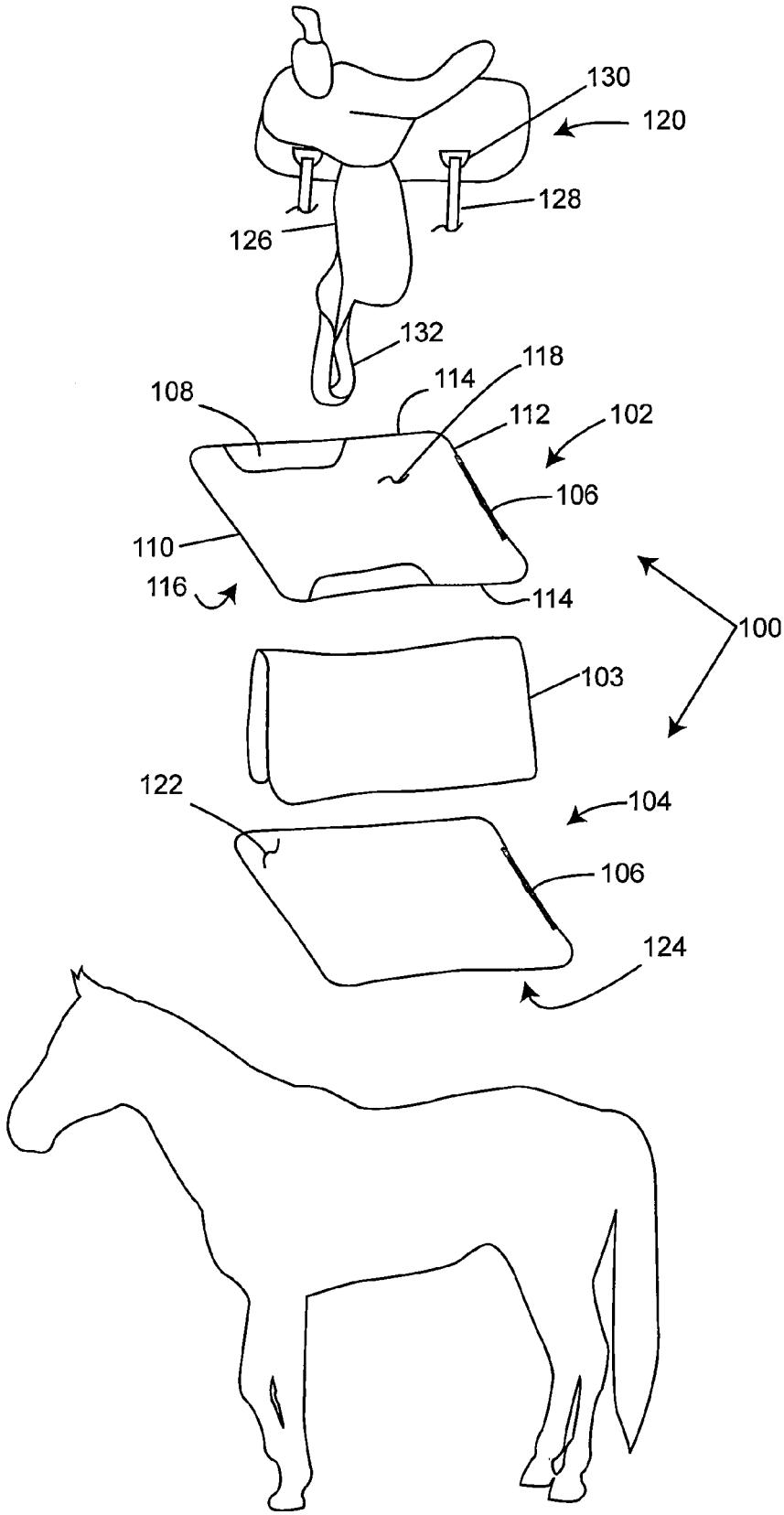
FIG. 3 is an exploded perspective view of a saddle pad assembly in position above a horse, according to certain embodiments.

Referring now to FIG. 3, the saddle pad cover 100 may include a saddle-side layer 102, a horse-side layer 104, a closure device 106, and one or a plurality of patches 108. The saddle-side layer 102 and the horse-side layer 104 may be coupled to one another along a length of their perimeter edges. The saddle-side layer 102 and the horse-side layer 104 may further be coupleable via the closure device 106 along a length of their perimeter edges.

The saddle-side layer 102 may be generally rectangular in shape and may take the shape of a square, having four substantially equal length edges, so as to facilitate a tight fit over a saddle pad. The edges may be defined as a front edge 110, a rear edge 112, and two lateral edges 114. The edges may be further defined by an in-use position, where the front edge 110 is the edge nearest the front of the horse, the rear edge 112 is the edge nearest the rear of the horse and the lateral edges 114 are the edges along the sides of the horse. The saddle-side layer 102 may have an inside surface 116 directed toward the saddle pad 103 and an exposed surface 118 directed toward the underside of the saddle 120. The saddle-side layer 102 may be dimensioned for a "one size fits all" application or may be dimensioned for a more custom application to a particular pad. In one embodiment the saddle-side layer 102 may have a length and a width ranging from approximately 16" to approximately 48". In another embodiment, the saddle-side layer 102 may have a length and a width ranging from approximately 24" to approximately 40". In still another embodiment, the saddle-side layer 102 may have a length and a width of approximately 32".

The saddle-side layer 102 may be made from most any material. In some embodiments, the saddle-side layer 102 may be made from a machine washable textile material. In this or other embodiments, the material may include one or a combination of cotton, wool, silk, polyester, acrylic, nylon, lycra, spandex, tactel, olefin, ingeo, faux furs, and faux skins or hides. Other natural and/or synthetic textiles or other materials may be used such as, for example, leather, felt, fleece, canvas, and suede. The material may be pre-washed and/or pre-shrunk. That is, the material may be washed and/or shrunk prior to cutting, sizing, and/or assembling the cover 100. The saddle-side layer 102 may be made from a single piece of fabric or may include multiple pieces of fabric combined to create a singe layer. Moreover, the saddle-side layer 102 may include multiple sub-layers of fabric to create the saddle-side layer 102. In still other embodiments, the saddle pad cover 100 may include one or a combination of textile designs. The designs may be any design and in some embodiments may include cultural, religious, and/or personal designs. The designs may be included at the time of manufacture of the cover or at the time of sale to a customer. That is, the nature of the relatively thin saddle pad cover 100 relative to the thicker saddle pads 103, may allow for post production personalization of the cover 100 through the use of embroidery, sewn on patchwork, or other personalization methods.

The horse-side layer 104 may also be generally rectangular in shape and may take the shape of a square, with four substantially equal length edges, so as to facilitate a tight fit over a conventional saddle pad 103. The horse-side layer 104 may also have an inside surface 122 directed toward the saddle pad 103 and an exposed surface 124 directed toward the back of the horse. The horse-side layer 104 may have dimensions the same as or similar to the saddle-side layer 102 and may be made from the same or similar materials and may include the same or similar pretreatments. In one embodiment, the saddle-side layer 102 and the horse-side layer 104 may be one piece of fabric that is folded over upon itself. Alternatively, the horse-side layer 104 may have different dimensions and may be made from a different material than the saddle-side layer 102. In one embodiment, the saddle-side layer 102 may be made from a cotton material and the horse-side layer 104 may be made from an imitation sheepskin or imitation lambswool material.

The saddle-side layer 102 and the horse-side layer 104 may be coupled together along their perimeter edges in any number of ways. The layers may be sewn, glued, buttoned, tied, pinned, or otherwise coupled together. In one embodiment, the to-be-exposed surfaces 118, 124 of the saddle-side layer 102 and the horse-side layer 104 may be placed facing each other and the perimeter edge may be sewn to form a seam leaving a portion of the perimeter edge not sewn. Subsequently, the cover 100 may be turned right side out using the portion of the seam that was not sewn. The resulting cover 100 may have a saddle-side layer 102 and a horse-side layer 104 that are coupled together with a secluded sewn stitch.

The saddle-side layer 102 and the horse-side layer 104 may further be coupleable along a length of their perimeter edges via a closure device 106. That is, they may be coupled and decoupled by a user by closing or opening the closure device 106, respectively. The closure device 106 may include a zipper, a plurality of snaps or buttons, a hook and loop system, a magnetic system, a plurality of buckles extending transversely to the seamed edge, or any other seam coupling device known in the art. In the case of a zipper, the zipper may be a toothed zipper or an interlocking sliding seam-type zipper. In one embodiment, the zipper may be a polyester all purpose zipper. In the case of a plurality of buckles, the buckles may be positioned on an overlapping flap on either the saddle-side layer 102 or the horse-side layer 104. The flap may overlap the opposing layer and be buckled thereto beyond the edge of said opposing layer thereby closing off the seam between the two layers.

The closure device 106 may extend along one edge of the cover 100 or along multiple edges. In one embodiment, the closure device 106 may extend along the full length of an edge. In another embodiment, the closure device 106 may extend along a partial length of an edge. In still another embodiment, the closure device 106 may have a length from approximately 16" to approximately 48". In another embodiment, the closure device 106 may have a length of approximately 24" to approximately 40". In another embodiment, the closure device 106 may have a length of approximately 32". In yet another embodiment, the closure device 106 may have a length of approximately 24".

As mentioned, the saddle pad cover 100 may also include one or a plurality of patches 108. The patches 108 may be overlaid on top of the saddle pad cover 100 or may be seamed in, such that they form a portion of the saddle-side layer 102, the horse-side layer 104, or a combination of each layer. The patches 108 may be coupled to the saddle pad cover 100 by sewing, gluing or otherwise adhering, buttoning, pinning, or any other attachment mechanism known in the art. The patches 108 may serve one or a plurality of purposes and, as such, may be made from suitable materials for a given purpose and may be positioned suitably for a given purpose. One of the purposes of the patches 108 may be to resist abrasion from one or a plurality of sources. As such, the patch may be denim, leather, faux leather (e.g. pleather), or any other abrasion resistive material known in the art. Several sources of abrasion on a saddle pad cover 100 may exist including rider leg wear, fender wear saddle wear, cinch wear, stirrup wear, pommel wear, and the like. Accordingly, the patches 108 may be positioned in a plurality of locations. The patches 108 may be positioned along the edges of the saddle pad cover 100 and may extend the full length of the edge or along a portion of the edge and may also extend along all or part of multiple edges. The patches 108 may alternatively be offset and/or isolated from the edges.

Figure 4:
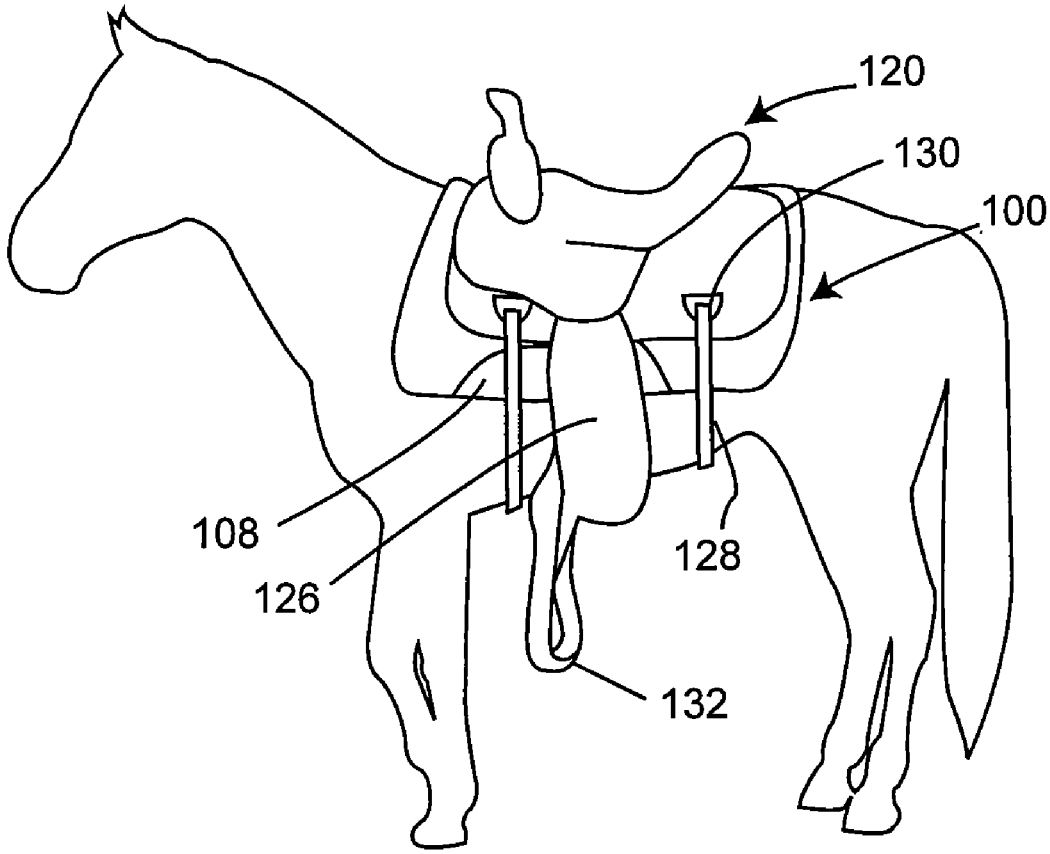
FIG. 4 is a perspective view of an assembled saddle pad assembly in position on a horse, according to certain embodiments.

In the embodiment shown in FIG. 1-3, the patches 108 may be adapted to resist abrasion near and/or around the fender 126 of a saddle 120 positioned upon the saddle pad cover 100. That is, as a horseback rider sits on a horse, their inner thigh, knee, and inner calf may rest below the saddle 120 and toward the front of the saddle pad 100 as best shown in FIG. 4. Between the rider and the horse, the saddle may include a fender 126 extending from the saddle 120 down toward the stirrup 132 thereby separating the rider from the horse. As a person rides a horse, a small amount of movement at a high repetition rate can create an abrasive affect. That is, as a person rides, and from time to time causes the horse to trot or even gallop, the pressure of their feet in the stirrups causes the stirrups to tend toward the middle of the horse drawing the fenders 126 in against the horse and the saddle pad 100. The repetitive jostling of the fenders 126 together with the inward pressure can cause abrasion along the inner surface of the fender 126.

Accordingly, in one embodiment, the patch 108 may extend along a portion of the lateral edge as shown. In this embodiment, the patch 108 may extend over approximately ⅔ of the lateral edge and may be centered on a point approximately ⅔ of the length of the edge starting from the rear edge of the saddle pad 100. In one embodiment, the patch 108 may extend along the lateral edge of the cover 100 and may have a length from approximately 12 inches to approximately 24 inches. In other embodiments the length may range form approximately 16 inches to approximately 20 inches. In still other embodiments, the patch may have a length of 18 inches or alternatively 19½ inches. The patch 108 may have a trapezoidal shape and may address the varying contact points defined by the location of the fender 126 and/or the rider's knee and pivoting lower leg. That is, the patch 108 may be centered at or near the position of a rider's knee so as to be in position to resist wear from the fender 126. The patch 108 in the present embodiment may be one of the abrasion resistive materials discussed above or any other abrasion resistive material known in the art. Additionally, the patch 108 may have any length and is not limited to ⅔ of the lateral edge, nor is it limited to the location described or the shape described. Any location or shape may be selected and may also be adapted to accommodate any area susceptible to wear.

At least one issue relating to saddle riding relates to the absorption of moisture, the moisture often being in the form of perspiration of the horse, water from splashing through streams, rain, or dew. Accordingly, the saddle pad cover 100 may include one or a plurality of water resisting or waterproofing systems. In one embodiment, this system may be an outer system and may be applied to the outer surface of the saddle pad cover 100. For example, the saddle pad cover 100 may have a water-resisting or waterproofing solution applied to its outer surface 118, 124 to resist and/or prevent the absorption of moisture and/or soiling. These solutions may include, but are not limited to fluoropolymer based sprays and the like. In some embodiments, this outer surface solution may be applied only to the saddle-side layer 102 so as to avoid contacting the horse and thus avoiding irritation of the horse. In another example, the saddle pad cover 100 may have a film of water resistant material positioned adjacent to its outer surface 118, 124. The film may be applied in liquid form or in the form of a film sheet. In the case of a film sheet, the sheet may be adhered to the outer surface 118. 124 of the saddle pad cover 100 or otherwise be secured to the cover 100. This outer system, whether in the form of an applied solution or a film, may protect the saddle pad cover 100 and the enclosed saddle pad 103 from moisture or soiling from the horse, the rider, or any other source of moisture or soiling.

In another embodiment, the saddle pad cover 100 may be made from a water resistant or waterproof material such as a polymer based material. This water resistant or waterproof material may be the same or similar to rain slicker materials known in the art. This system may protect the saddle pad cover 100 and the enclosed saddle pad 103 from absorbing moisture.

In another embodiment, the system may be an inner system and may be applied to the inner surface 116, 122 of the saddle pad cover 100. For example, the saddle pad cover 100 may have a water-resisting or waterproofing solution applied to its inner surface to resist and/or prevent the absorption of moisture and/or soiling. Solutions such as known fluoropolymer base sprays and the like may also be used. In another example, this saddle pad cover 100 may have a film of material positioned adjacent to its inner surface 116, 122. The film may be applied in liquid form or in the form of a sheet. In the case of a sheet, the sheet may be adhered to the inner surface 116, 122 of the saddle pad cover 100 or otherwise secured to the cover 100. This inner system may not protect the saddle pad cover 100 from moisture or soiling on its outer surface 118, 124, but may protect the enclosed saddle pad 103 from moisture or soiling from the horse, the rider, or any other source of moisture or soiling. As such, while the saddle pad cover 100 may need to be washed, the saddle pad 103 may not need to be washed. This inner system may avoid irritation to a horse's hide since the horse may avoid contact with the water resistant membrane or film.

In some embodiments, a polyurethane laminate ("PUL") fabric may be used. In some embodiments, the polyurethane may be positioned on the inner surface 116, 122 of the fabric. The fabric used with the polyurethane may be a polyester knit or a cotton material, or any other material. The PUL may have a thickness ranging from 0.25 mils to 5 mils. In other embodiments, the PUL may have a thickness ranging from and including 1 mil up to and including 2 mils. This PUL fabric may be machine washable and thus maintain its water resistance after repeated washing.

In addition to the water-resisting or waterproofing systems discussed above, there may be a desire for at least one wicking layer to be in contact with the horse to wick the perspiration away from the horse's hide. As such, where the water resisting system is an inner system, the horse-side layer 104 may comprise a material with suitable wicking properties. Some of these materials may include the lambswool and sheepskin materials discussed above, but may also include fleece, micro fleece, or other known wicking materials.

In addition to moisture concerns, slippage of the saddle 120 is another known problem associated with saddle riding. A saddle 120 may often be secured on a horse's back with a cinch strap 128 or plurality of cinch straps 128 that extend from a D-ring 130 on one side of the saddle 120, down around the horse's abdomen, and up to a D-ring 130 on the opposing side of the saddle. Additionally, stirrups 132 may extend from the saddle 120 for placing a rider's foot when mounting and/or riding the horse. Slippage of a saddle 120 may occur when a rider shifts his/her weight too much toward one side and thus presses on one stirrup 132 more heavily than the other side. For example, slippage may occur upon mounting the horse or otherwise as a rider attempts to turn the horse or maintain their balance while riding.

Slippage may occur along one or a plurality of cleavage planes. Saddle pads 103, being placed between the saddle 120 and the horse, may add at least one cleavage plane to the saddle system that would not be present were the saddle pad 103 omitted. That is, without a saddle pad 103, one cleavage plane between the bottom surface of the saddle 120 and the horse may exist. Once a saddle pad 103 is placed, a cleavage plane between the bottom surface of the saddle 120 and the saddle pad 103 in addition to the cleavage plane between the saddle pad 103 and the back of the horse may exist.

Prevention of slippage along any and/or all of these planes may be contributed to by a variety of factors where these factors often work together. Prevention of slippage may be contributed to by tightening the cinch straps 128. That is, as the straps 128 are tightened, the compressive force normal to the surfaces forming one or a plurality of the cleavage planes may increase. This increase in normal force on the surfaces may increase the frictional resistance to slippage across these planes. Additionally, the nature of the surface textures of the surfaces in contact across the cleavage planes may also contribute. That is, generally, where relatively rough surfaces are in contact across a cleavage plane, the coefficient of friction for sliding along that plane may increase. This increase in the coefficient of friction may increase the frictional resistance to slippage across these planes. Accordingly, it may be found that the smoother the materials are that are in contact across one or a plurality of the cleavage planes, the more tightening that will be necessary to avoid slippage of the saddle 120 and the more uncomfortable the horse may be. However, it may also be noted that where one surface is relatively rough, the opposing surface may not be, and yet the frictional resistance may be sufficient. This may be true as long as the smoother of the two surfaces is not overly smooth. For example, a lambswool lined saddle 120 positioned upon a nylon saddle pad 103 may slip quite heavily.

Regarding the cleavage plane between the bottom surface of the saddle 120 and the saddle-side layer 102, saddles 120 may include faux fur, sheepskin, lambswool or other padding-type materials on their bottom surface such that they may be used without a saddle pad 103. These materials, while soft when pressed upon, may be considered rough when compared to fabrics such as silk, nylon, leather or other generally smooth materials. As such, a saddle 120 used without a saddle pad 103, where the relatively rough bottom is in contact with the relatively smooth hair on a horse's back, may have sufficient resistance to slippage to avoid having to overly tighten the straps 128. As such the saddle-side layer 102 of the saddle pad cover 100 may be relatively rough or may not be. In either case, the saddle-side layer 102 may provide sufficient frictional resistance due to the relatively rough surface of the saddle 120.

Regarding the cleavage plane between the bottom of the horse-side layer 104 and the back of the horse, the horse-side layer 104 may include a relatively rough material as previously described. (e.g., lambswool, sheepskin, faux fur, etc.) As such, the horse-side layer 104 may provide slip resistance to the cleavage plane and thus prevent having to over-tighten the straps 128.

In addition to the cleavage planes mentioned, the saddle pad cover 100 may have two additional cleavage planes between the inner surface 116 of the saddle-side layer 102 and the pad 103 and between the inner surface 122 of the horse-side layer 104 and the pad 103. In some embodiments, the saddle pad 103 may be a foam pad or other padding material. In some embodiments, the inner surface 116, 122 of a layer of a given saddle pad cover 100 may engage the pad with sufficient friction to assist in preventing slippage. In other embodiments, the inner surface 116, 122 of the saddle pad cover 100 may be lined with a gripping material, such as a hook and loop material, a rubberized material, and the like. In yet another embodiment, the saddle pad 103 may include an opposing gripping material for frictionally engaging the gripping material on the inner surface 116, 122 of the saddle pad cover 100.

In one embodiment, as previously discussed, the saddle pad cover 100 may be lined with a water resistive or waterproofing system. In these cases, this system may make the inner surface 116, 122 of the cover 100 relatively smooth or slick. Accordingly, one or several of the slippage resisting systems described for preventing slippage between the saddle pad cover 100 and the saddle pad 103 may be included. In one embodiment, this may include a grit material within the waterproofing system. The slippage prevention system may alternatively include strips, patches, or a web of gripping material adhered to the inner surface of the lined saddle pad cover 100 for engaging the saddle pad 103. In still another embodiment, the whole inner surface of the waterproof lined saddle pad cover 100 may be further lined with a gripping material adhered to the waterproof lining.

In still another embodiment, a second cover may be provided. This cover may be a moisture protection cover and may have any and/or all of the features of the saddle pad covers 100 described herein. This cover may be made from one of several known water-resistive or waterproofing materials including, but not limited to PUL fabric, coated nylon, several polymer based materials and the like. Depending on this moisture protection cover's resistance to slippage, this moisture protection cover may include patches, strips, or a web of gripping material adhered to the inner and/or outer surfaces of the cover. In use, this moisture protection cover may be sleeved over the saddle pad 103 and the saddle pad cover 100 may, in turn, be sleeved over the moisture cover. The saddle pad cover 100 may include corresponding strips, patches, or webs of gripping materials on its inner surface for engaging the same on the exterior of the moisture protection cover.

In still another embodiment, a saddle pad 103 may be provided that is coated to prevent absorption of moisture. The saddle pad 103 may have a polymer based, rubberized, or other non-permeable coating. In some embodiments, this coating may be relatively smooth and slick. As such, in some embodiments, this coating may be impregnated with a grit, sand, or other gripping-type material. Accordingly, when sleeved inside a fabric saddle pad cover 100, slippage may be resisted by the engagement between the inner fabric surface of the saddle pad cover 100 and the gritty surface of the saddle pad 103.

While the above disclosure includes detailed discussion of elements of or relating to the invention, many modifications may be made and still fall within the scope of the present invention. For example, in one embodiment, the patch 108 may be decorative and may have a decorative pattern. The patch 108 may be the same color or a contrasting color to the saddle-side layer 102. The decorative patch 108 may allow for embroidered symbols, ranch insignias, initials, or other decorative features known in the art. The decorative patch 108 may be any size, shape, color, or pattern, and may be located anywhere on the saddle-pad cover 102. It may be located on the saddle-side layer 102 or the horse-side layer 104 and may be located in a hidden area (e.g., covered by the saddle 120 or in contact with the horse) or an exposed area. For example, a good luck charm-type patch 108 may be located below the saddle 120.

Another modification may relate to the closure device 106. In one embodiment, the closure device 106 may not extend along the seam between the layers as previously discussed. The closure device 106 may be perpendicular to or at some other angle to the layers. For example, a closure device 106 may extend longitudinally along a surface of the cover 100 from the front to the rear of the cover 100. That is, the closure device 100 may bisect the saddle-side layer 102 allowing for ease of insertion of a contoured or curved saddle pad 103 similar to that shown in FIG. 3. For example, the closure device 106 may be opened or the cover 100 may be folded slightly in half at the closure device 106 allowing for the legs of the pad 103 to slip smoothly through. The closure device 106 may then be closed.

Another modification may relate to the layers of the cover 100. While the layers have been referred to as a saddle-side layer 102 and a horse-side layer 104, the cover 100 may be made with a seam that runs in a different direction. As such, the layers may be a right layer and a left layer rather than a saddle-side layer 102 and a horse-side layer 104. Moreover, the number of layers may be any number and multiple layers may be included with multiple closure devices 106. The layers may be in any arrangement and are not limited to opposing layers. The layers may be adjacent to one another and be seamed or otherwise coupled together. Any array of layers may be used to create the cover 100. Moreover, layer does not necessarily imply more than.

Figure 5A:
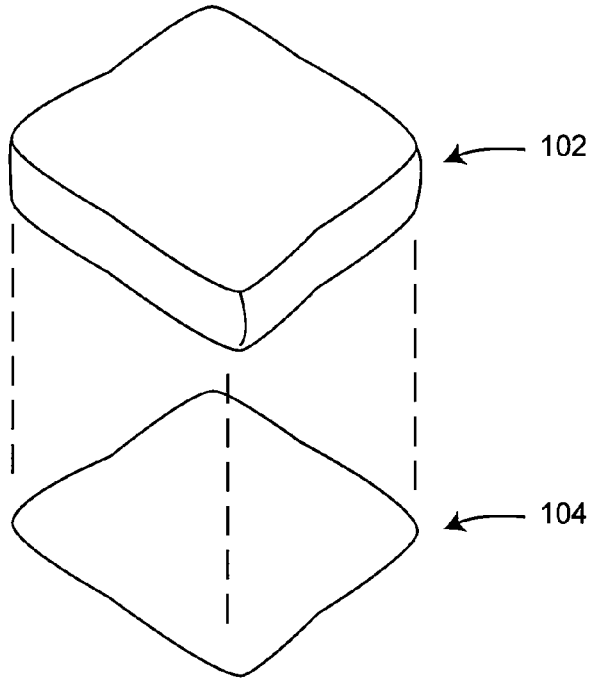
FIGS. 5A and 5B are perspective views of a cover according to certain embodiments.
Figure 5B:
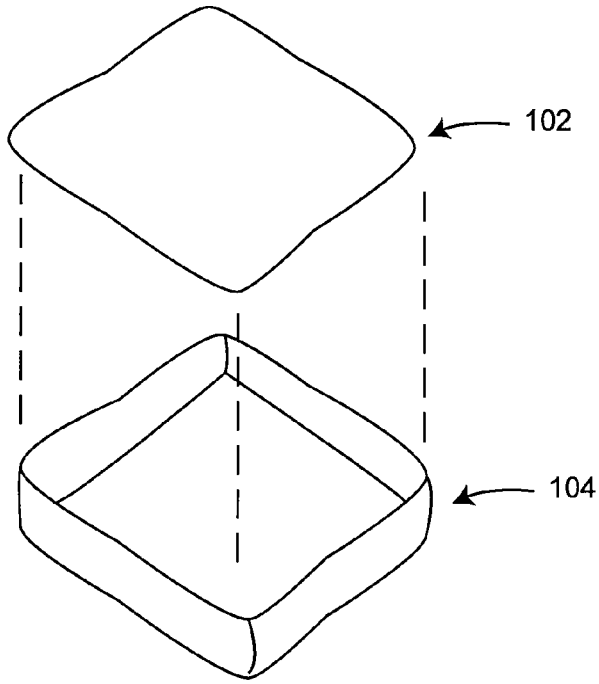

Another modification may relate to the tailoring and shape of the saddle-side layer 102 and the horse-side layer 104. In one embodiment, the saddle-side layer 102 and horse-side layer 104 may be generally planar or may be tailored to accommodate the 3-dimensional corners of a pad 103. (e.g. as shown in FIG. 5A) The saddle-side layer 102 or the horse-side layer 104 may have returns at its edges that extend along the lateral sides of the pad 103. For example, as shown in FIG. 5A, the horse-side layer 104 may have a length and width slightly smaller than the length and width of the saddle-side layer 102 so as to allow the saddle-side layer 102 to extend over and down along the edges of the saddle pad 103 thereby reducing the exposure of the horse-side layer 104 to view. The corners of the saddle-side layer 102 may be tailored accordingly to accommodate the saddle pad 103 shape. In another embodiment, as shown in FIG. 5B, the horse-side layer 104 may have a length and width larger than the saddle-side layer 102 allowing the horse-side layer 104 to extend over and up along the edges of the saddle pad 103 thereby increasing the exposure of the horse-side layer 104. The corners of the horse-side layer 104 may also be tailored accordingly.

Figure 6:
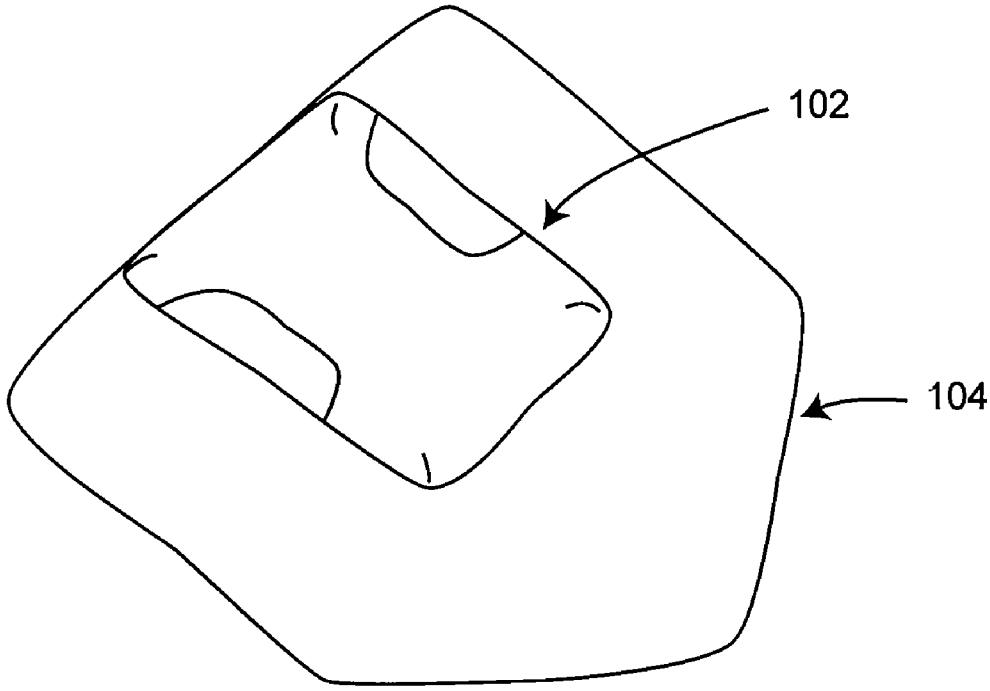
FIG. 6 is a perspective view of a saddle pad cover according to certain embodiments.

Another modification involves the shape and size of the saddle-side layer 102 and/or the horse-side layer 104. Any shaped saddle-side layer 102 or horse-side layer 104 may be used including rectangular, round, oval, triangular, or any design shape, such as a star, the shape of a state, a state logo, a county, and the like. In one embodiment, as shown in FIG. 6, an oversized saddle-side layer 102, which may be larger than the saddle pad 103 and the horse-side layer 104, may be provided. In this embodiment, the coupling of the saddle-side layer 102 to the horse-side layer 104 may be adapted to create a tight fitting cover allowing the excess material of the saddle-side layer 102 extending beyond the coupling line 134 to be decorative. That is, the saddle-side layer 102 may, for example, include a zipper within its boundary and not along its edges for attachment of the horse-side layer 104. The horse-side layer 104 may be adapted to fit the saddle pad 103 tightly and the portion of the saddle-side layer 102 beyond the zipper may be excess. In other embodiments, the horse-side layer 104 may be oversized and the saddle-side layer 102 may be tailored for a tight fit of the saddle pad 103. Alternatively, any shaped cover 100, including the saddle-side layer 102 and the horse-side layer 104 may be used. In some embodiments, internal batting or stuffing may be used together with the saddle pad cover 100 to make for a tight fit.

In still other embodiments, the saddle pad cover 100 may be adjustable for multiple sized saddle pads 103. This adjustability may be in the form of multiple rows of coupling mechanisms located on a given layer, such as multiple lines of buttons, zippers, or hook and loop on one or both of the saddle-side layer 102 and the horse-side layer 104. As such, the saddle-side layer 102 and the horse-side layer 104 may be coupled together along a selected line thereby allowing for a selected size of cover 100. This adjustability may also take the form of a series of straps or other devices that allow the inside size of the cover 100 to be adjustable.

In still other embodiments, the saddle pad cover 100 may be convertible. That is, the one or plurality of layers included in the cover 100 may be decoupleable and interchangeable with other layers. For example, the horse-side layer 104 and the saddle-side layer 102 may be decoupleable at their perimeter with a coupling mechanism that extends the full perimeter. As such, the saddle-side layer 102 may be interchanged for decorative or other purposes. The horse-side layer 104 may be interchanged for purposes such as weather, where heavier layers may be used in colder temperatures and/or climates. The horse-side layer 104 may also be interchanged due to saturation from perspiration of a horse. Other reasons will be known to those of skill in the art for changing or swapping the plurality of layers of the cover.

Similarly, in another embodiment, the patches 108 may be interchangeable. The patches 108 may be coupled to the saddle pad cover 100 with hook and loop, buttons, snaps, zippers, or any other decoupleable fastening mechanism. The fastening mechanism may be a decoupleable mechanism allowing the patches 108 to be removed and replaced for several reasons such as wear, color changes, soiling, or otherwise.

In use, the saddle pad cover 100 may be sleevably position over a saddle pad to create a saddle pad assembly 101. Where internal gripping material has been included on the cover 100 and the pad 103, alignment of the gripping material may be completed. The closure device 106 may be closed thereby securing the saddle pad 103 within the cover 100. The saddle pad assembly 101 may be placed upon the back of a horse and positioned to fall beneath a saddle 120. A saddle 120 may then be placed on top of the saddle pad assembly 101 and secured with one or a plurality of cinch straps 128. The saddle pad cover may function to prevent soiling of the saddle pad during rides or when the saddle pad would otherwise be subject to soiling. The saddle 120 may then be removed from the horse. The saddle pad assembly 101 may also be removed and the closure device 106 may be opened allowing the saddle pad 103 to be removed. The saddle pad cover 100 may then be treated in a plurality of ways. The saddle pad cover 100 may be collapsed, crumpled, folded, or otherwise reduced in size for storage or transportation. The saddle pad cover 100 may be replaced with a new saddle pad cover 100 for additional riding or activities. This may be for purposes of refreshing the saddle pad cover 100 or for a change in look of the saddle pad cover 100. The saddle pad cover 100, having been removed from the saddle pad 103, may be placed in a washing machine or otherwise washed by hand in a sink, tub, or other basin. The flexible and collapsible nature of the saddle pad cover 100 relative to a saddle pad 103 may allow for the use of much smaller machines, sinks, tubs, or basins. The saddle pad cover 100 may then be arranged for drying. This may include placing the cover 100 in a dryer, hanging the cover on a line, pinning or clipping the cover to a surface, draping the cover over a structure, or any other drying technique. This process may be repeated a multitude of times at a frequency desired by the user.

Although the present invention has been described with a certain degree of particularity, it is understood the disclosure has been made by way of example, and changes in detail or structure may be made without departing from the spirit of the invention as defined in the appended claims.

What is claimed is:

1. A saddle pad assembly for use with a western saddle having a fender, the saddle pad assembly comprising:

a saddle pad consisting of a single, substantially unitary, homogenous, and rectangular pad configured for placement between a saddle and a horse and for cushioning a horse from pressures exerted by the saddle; and a saddle pad cover sleevably arranged over the saddle pad, the cover comprising:

a horse-side layer and a saddle-side layer, each layer having a peripheral edge made up of a front edge, two lateral edges, and a back edge, the peripheral edge defining a substantially rectangular shape matching the rectangular shape of the saddle pad, the horse-side layer and saddle-side layer being coupled to one another along respective peripheral edges thereof forming a periphery of the cover, the horse-side layer being constructed of a first material and the saddle-side layer being constructed of a second material different from the first material;

a pair of wear-resistive patches, each patch being arranged on the saddle-side layer, along respective lateral edges, and generally toward the front edge so as to fall below be underneath and adjacent an underside of the fender of the saddle when the saddle is in place on the saddle pad and the fender is extending downward along a side of the horse; and a zipper-type closure device arranged along the back edge of the cover and adapted to selectively open and close the cover for insertion and removal of the saddle pad.

2. The saddle pad assembly of claim 1, further comprising a water resistive system.

3. The saddle pad assembly of claim 2, wherein the water resistive system is an inner system.

4. The saddle pad assembly of claim 3, wherein the water resistive system is a polyurethane laminate fabric.

5. The saddle pad assembly of claim 1, wherein the horse-side layer includes a relatively rough material adapted to engage the back of the horse.

6. The saddle pad assembly of claim 5, wherein the relatively rough material is faux fur.

7. The saddle pad assembly of claim 6, wherein an inner surface of the saddle pad cover includes a gripping material.

8. The saddle pad assembly of claim 7, wherein the saddle pad includes gripping material in opposing position relative to the gripping material on the cover.

9. A saddle assembly for supporting a rider on a horse, the saddle assembly comprising:

a saddle having a seat for supporting the rider and a fender extending downward from the seat;

a single, substantially unitary, homogenous, and rectangular saddle pad configured for placement between the saddle and the horse and for cushioning the horse from pressures exerted by the saddle; and a saddle pad cover sleevably arranged over the saddle pad, the cover comprising:

a horse-side layer and a saddle-side layer, each layer having a peripheral edge made up of a front edge, two lateral edges, and a back edge, the peripheral edge defining a substantially rectangular shape matching the rectangular shape of the saddle pad, the horse-side layer and saddle-side layer being coupled to one another along respective peripheral edges thereof forming a periphery of the cover, the horse-side layer being constructed of a first material and the saddle-side layer being constructed of a second material different from the first material;

a pair of wear-resistive patches, each patch being arranged on the saddle-side layer, along respective lateral edges, and generally toward the front edge so as to fall be underneath and adjacent an underside of the fender of the saddle when the saddle is in place on the saddle pad and the fender is extending downward along a side of the horse; and a zipper-type closure device arranged along the back edge of the cover and adapted to selectively open and close the cover for insertion and removal of the saddle pad.

* * * * *

UNITED STATES PATENT AND TRADEMARK OFFICE

CERTIFICATE OF CORRECTION

PATENT NO. : 8,291,682 B2
APPLICATION NO. : 12/491086
DATED : October 23, 2012
INVENTOR(S) : Aimee A. Dodson and Gladys M. Woldt It is certified that error appears in the above-identified patent and that said Letters Patent is hereby corrected as shown below:

Page 1, Column 1, Section (63):
In the Related U.S. Application Data section, delete "Continuation" and insert --Continuation-in-part-- therefor.

Signed and Sealed this
Eighteenth Day of December, 2012

David J. Kappos

David J. Kappos
*Director of the United States Patent and Trademark Office*